US005262209A

United States Patent [19]

Sawyer

[11] Patent Number: 5,262,209

[45] Date of Patent: Nov. 16, 1993

[54] FINIAL WITH MOUNT FOR GLASS ORNAMENT

[76] Inventor: Gerald F. Sawyer, 2862 Tree Top Rd., Dacula, Ga. 30211

[21] Appl. No.: 947,576

[22] Filed: Sep. 21, 1992

[51] Int. Cl.[5] ..... B44C 5/00

[52] U.S. Cl. ..... 428/28; D26/154; 362/358

[58] Field of Search ..... 362/457, 351, 358; 428/28; 248/310, 314; D26/138, 142, 154

[56] References Cited

U.S. PATENT DOCUMENTS

D. 70,037 4/1926 Villaret ..... D26/154
1,074,673 10/1913 Weiss ..... 428/28
2,311,838 2/1943 Koch ..... 428/28

*Primary Examiner*—Carroll B. Dority
*Attorney, Agent, or Firm*—James B. Middleton

[57] ABSTRACT

For attaching an ornament of glass or the like to a finial base, an attachment device has a base that is fixed directly to the finial base, and a cup to receive the ornament. The cup is rigid, and is shaped the same as the ornament so no bending or other manipulation of the cup is required prior to attachment. In attaching the ornament, therefore, a quantity of adhesive is placed into the cup, and the ornament urged into the cup. The adhesive spreads out uniformly between the cup and the ornament, and the finial is allowed to sit while the adhesive cures.

2 Claims, 2 Drawing Sheets

FINIAL WITH MOUNT FOR GLASS ORNAMENT

BACKGROUND OF THE INVENTION

1. Field of the Invention

This invention relates generally to finials for lamps or the like, and is more particularly concerned with a finial having a mounting means for receiving an ornament, and a method for securing an ornament to a finial base.

2. Description of the Prior Art

Finials for lamps or the like typically include a finial base having a mounting flange on the top of the base. An ornament, or decorative element, is secured to the mounting flange by means of a screw or the like passing from a bore in the base into the ornament. Such an arrangement is reasonably satisfactory for the most common forms of ornaments fixed to finials. In the event one wishes to secure a glass ornament to a finial base, however, the usual technique is not practicable. Rather, one must fix some form of attachment means to the glass ornament, the attachment means being fixed also to the finial base. The prior art technique for attaching glass ornaments to finial bases includes the use of jewelers baskets or fingers. The fingers, for example, are fixed to the finial base by a screw, the individual fingers are shaped to conform to the glass ornament, then an adhesive is applied to the fingers, and the ornament is carefully held while the adhesive sets. It will be understood that this prior art technique is very tedious and time consuming. The fingers, or the basket, must be shaped to conform to the specific ornament, and the adhesive must be applied to the individual fingers; then, the ornament must be held carefully aligned while the adhesive sets.

SUMMARY OF THE INVENTION

The present invention provides a mount for a glass ornament or the like, the mount being receivable directly on a finial base. The mount of the present invention comprises a generally solid cup that is shaped to conform substantially with the ornament to be mounted. Thus, a mount is fixed to a finial base, adhesive is applied to the mount, and an ornament is inserted into the mount, causing the adhesive to spread out between the mount and the ornament.

The invention as disclosed herein relates to a crystal ornament for a finial, but it will be readily understood that the ornament may be glass, ceramic or other materials that will not satisfactorily receive a screw therein.

BRIEF DESCRIPTION OF THE DRAWINGS

These and other features and advantages of the present invention will become apparent from consideration of the following specification when taken in conjunction with the accompanying drawings in which.

DETAILED DESCRIPTION OF THE EMBODIMENTS

Figure 1:
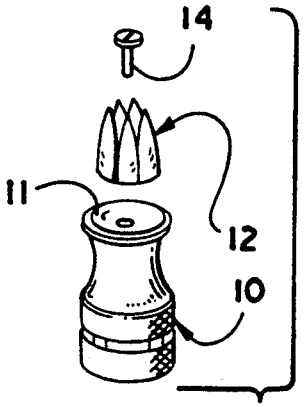
Fig 1 PRIOR ART
FIG. 1 is an exploded, perspective view showing the prior art arrangement wherein jeweler's fingers are fixed to the mounting flange of a finial base.
Figure 2:
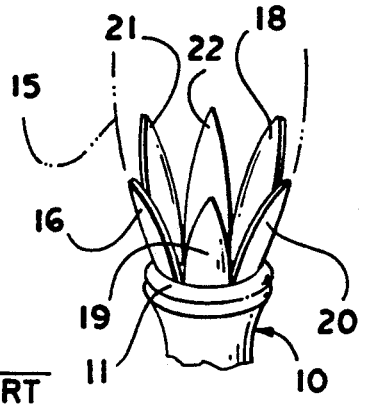
Fig 2 PRIOR ART
FIG. 2 is an enlarged, fragmentary view showing the fingers of FIG. 1 shaped to receive an oval ornament.
Figure 3:
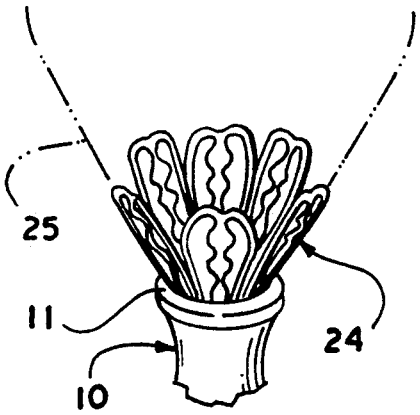
Fig 3 PRIOR ART
FIG. 3 is a view similar to FIG. 2 but showing a jeweler's basket shaped to receive a generally circular ornament.

Referring now more particularly to the drawings, and to those embodiments of the invention here presented by way of illustration, FIGS. 1–3 show the prior art means for securing a glass or similar ornament to a finial base. It will be understood by those skilled in the art that the prior art includes a finial base 10 having a threaded bore (not shown) in the bottom of the finial base, and a mounting flange 11 on the top of the finial base. A screw is normally passed through the finial base 10, through the mounting flange 11, and into an ornament received on the mounting flange 11. However such an arrangement is not practicable with ornaments made of glass, crystal, ceramic and comparable materials.

To secure, for example, a glass ornament to the finial base 10, the prior art technique is to utilize an attachment means 12 which is secured to the mounting flange 11 by a screw 14. The attachment means 12 is usually a standard item such as jeweler's fingers, and this is illustrated in FIG. 1 of the drawings. After the jeweler's fingers 12 are secured to the mounting flange 11, the plurality of fingers must be shaped to conform to the surface of the ornament to be secured. Since one would use the jeweler's fingers only for an irregularly shaped object, it will be understood that the shaping of the fingers is tedious and time consuming.

In the example shown in FIG. 2 of the drawings, the ornament 15 is a generally flat and oblong, tear-drop-shaped ornament. For such an ornament, it will be seen that the fingers 16 and 18 extend widely outward to contact the narrow edges, and the fingers 19–22 must be flattened and oriented to engage the sides of the ornament 15. Since the fingers, in the beginning, were arranged in a circle, it will be understood that each finger must be shaped and reoriented to provide the necessary attachment for the ornament 15.

Once the fingers are oriented to receive the ornament 15, an adhesive must be applied to each of the fingers; then, the ornament will be put into place, and the entire assembly carefully held in a jig to maintain the proper position, with the fingers in contact with the ornament, while the adhesive sets.

The device shown in FIG. 3 is substantially the same as the embodiment shown in FIGS. 1 and 2, except that the attachment means 24 comprises a jeweler's basket. The basket 24 can accept more nearly uniform ornaments such as the ornament 25. The individual pieces of the basket 24 are wider and cannot be manipulated to the same extent as the fingers of the device 12; rather, the basket 24 is utilized for more nearly uniform ornaments such as the generally spherical ornament 25. Even so, the pieces must be bent outwardly and shaped to conform precisely to the exterior surface of the ornament 25. After the pieces of the basket 24 are properly shaped, adhesive will be applied as discussed in connection with the embodiment of FIGS. 1 and 2, and the ornament will be held until the adhesive sets.

The present invention provides an attachment means for fixing an ornament of glass or the like to a finial base. The embodiment of the invention shown in FIG. 4 of the drawings is designed to mount an ornament such as the ornament 15 illustrated in FIG. 2.

Figure 4:
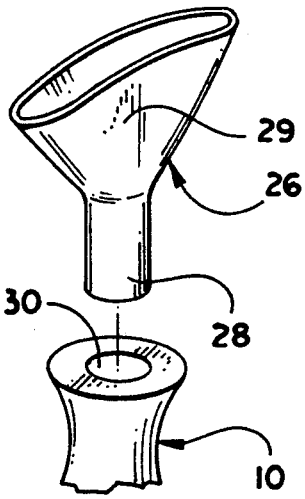
FIG. 4 is a perspective view showing a mount made in accordance with the present invention exploded from a conventional finial base.
Figure 5:
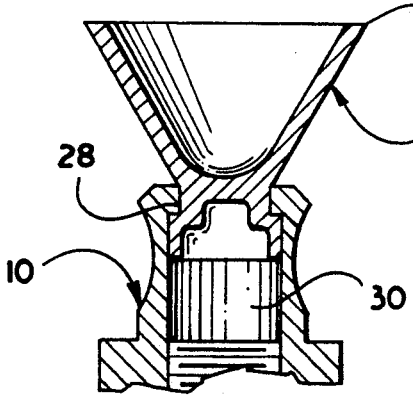
FIG. 5 is a cross-sectional view showing the mount of FIG. 4 fixed to the finial base.

The attachment means 26 shown in FIG. 4 includes a generally cylindrical base 28 and an attaching portion 29. It will be noticed that the finial base 10 does not have a mounting flange 11, which saves both a piece and the time for attaching a separate piece to the base 10. Rather, the base 28 of the attachment 26 is sized to be received within the conventional bore 30 in the finial base 10. As can be seen in FIG. 5, the base 28 of the attachment means 26 is swaged inside the bore 30 to secure the attachment means 26 to the finial base 10.

Thus, it will be understood by those skilled in the art that the attachment means 26 will include a cup-like attaching portion 29 pre-shaped to receive the elongated and somewhat pointed ornament, such as the ornament 15. Fixing of the attaching means 26 to the finial base 10 is quick and easy, and no subsequent shaping is required. This will be discussed in more detail hereinafter.

Figure 6:
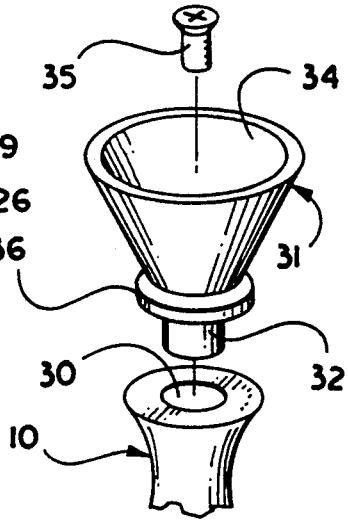
FIG. 6 is a view similar to FIG. 4 but showing a modified form of mount.
Figure 7:
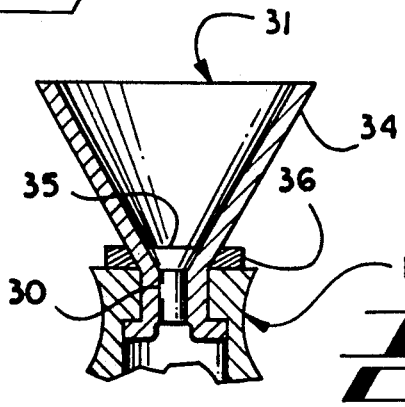
FIG. 7 is a view similar to FIG. 5, but showing the mount of FIG. 6.

Attention is next directed to FIG. 6 of the drawings which shows a modified form of the invention. In the embodiment of FIG. 6, there is an attachment means 31 having a base 32 and an upper attaching portion 34. As before, the base 32 will be received within the bore 30 of the finial base 10. In this embodiment of the invention, the attachment means 31 is secured to the finial base by a rivet 35, the rivet being swaged inside the bore 30 as is shown in FIG. 7 of the drawings.

Also as in the previous embodiment of the invention, the mounting flange 11 has been omitted from the finial base 10. However, there is a limiting ring 36 surrounding the attaching portion 34. The limiting ring 36 provides a bearing surface for rotation of the ornament on the finial base. The attaching portion 34 thus provides a means for readily receiving an ornament such as the ornament 25, with no subsequent shaping.

The attachment means 26 and 31 are here shown by way of illustration. While the two shapes are adapted to mount commonly used ornaments, numerous other shapes are equally possible, and are equally considered as included in the present inventive concept. The object of the present invention is to provide a pre-shaped attachment means that is directly fixable to a finial base, and that receives an ornament therein. Such a device removes the time and effort required to fixed an attachment means to a finial base, then to shape the attachment means to receive the intended ornament.

Figure 8:
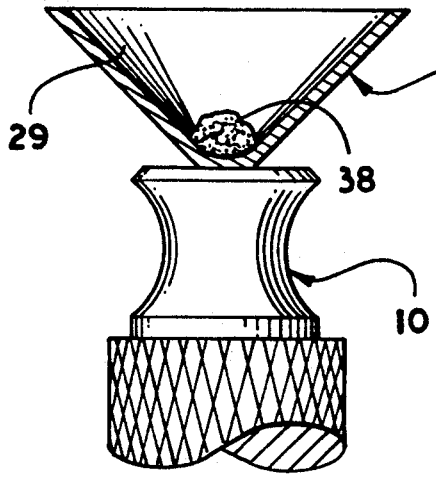
FIG. 8 is a view similar to FIG. 5 showing adhesive received within the mount.

The present invention also renders the step of fixing the ornament to the attaching portion much easier than in the prior art. Since the attaching portion 29 in FIG. 8 is pre-shaped to receive, and to support, the ornament 15, a quantity of adhesive 38, such as an epoxy, is placed into the cup-like opening in the attaching portion 29. The ornament 15 is then simply urged into the attaching portion 29 so the adhesive 38 is forced outwardly to fill the small space between the ornament 15 and the attaching portion 29.

Figure 9:
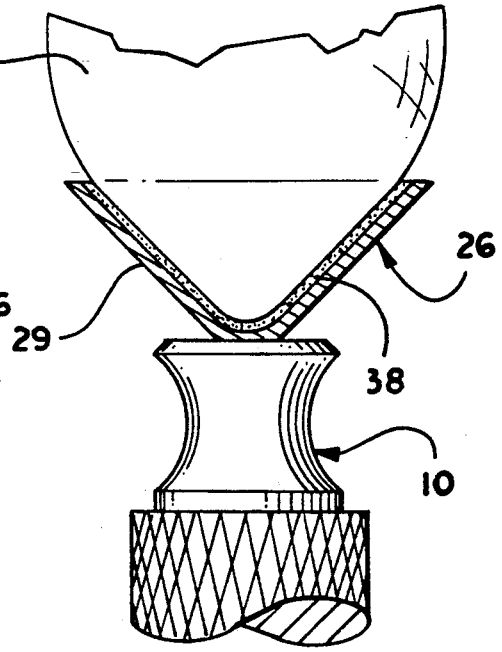
FIG. 9 is a view similar to FIG. 8 but showing an ornament in place; and, FIGS. 10 and 11 are views similar to FIGS. 8 and 9, but showing the mount of FIG. 6.

Once the ornament 15 is in place as shown in FIG. 9 of the drawings, little or no additional support is required while the adhesive sets.

Figure 10:
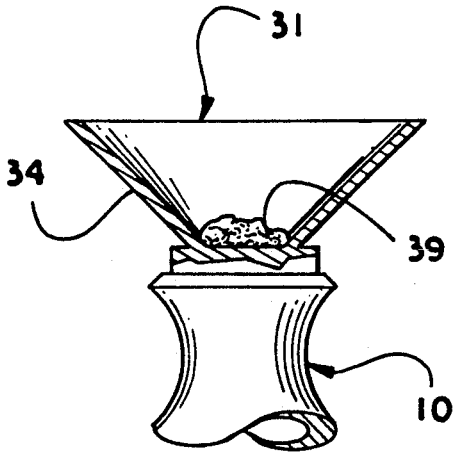
Figure 11:
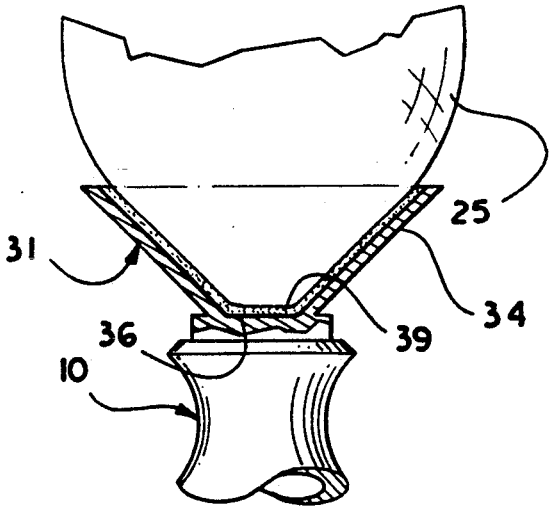

FIGS. 10 and 11 of the drawings show the fixing of the ornament 25 to the attachment means 31. FIG. 10 illustrates the quantity of adhesive 39, and FIG. 11 shows the ornament 25 in place, and the adhesive 39 filling the space between the ornament 25 and the attaching portion 34.

From the above discussion it will be understood that the attachment means may be made in any of numerous shapes. For small quantities, the devices can be machined, but for larger quantities the devices may be die cast. In any event, having an attaching portion that fits the ornament to be used allows the attaching portion to receive a quantity of adhesive, so the ornament can be just forced into the attaching portion to complete the assembly.

It will of course be understood by those skilled in the art that the embodiments of the invention here presented are by way of illustration only, and are meant to be in to way restrictive; therefore, numerous changes and modifications may be made, and the full use of equivalents resorted to, without departing from the spirit or scope of the invention as outlined in the appended claims.

I claim:

1. Attachment means for a finial, wherein said finial includes a finial base and an ornament fixed to said having a central bore therein, said ornament having a bottom portion to be received by said attachment means, said attachment means comprising a base portion being received within said central bore, means for holding said base portion within said central bore, and an attaching portion for receiving said bottom portion of said ornament, said attaching portion of said attachment means being substantially rigid and shaped substantially the same as said base portion of said ornament, and means for securing said ornament to said attaching portion of said attachment means.

2. Attachment means as claimed in claim 1, said attaching portion being generally cup-shaped for receiving said base portion of said ornament, said means for securing said ornament to said attaching portion comprising an adhesive within said cup-shaped attaching portion.

* * * * *

UNITED STATES PATENT AND TRADEMARK OFFICE

CERTIFICATE OF CORRECTION

PATENT NO. : 5,262,209

DATED : November 16, 1993

INVENTOR(S) : Gerald F. Sawyer

It is certified that error appears in the above-indentified patent and that said Letters Patent is hereby corrected as shown below:

Claim 1, column 4, line 39, after "finial base" insert --having a central bore therein--;

after "said", at the end of the line, add --finial base--;

line 40, delete "having a central bore therein".

Signed and Sealed this

Twentieth Day of September, 1994

*Attest:*

*Attesting Officer*

Bruce Lehman

BRUCE LEHMAN

*Commissioner of Patents and Trademarks*